US005317291A

United States Patent [19]

Podell

[11] Patent Number: 5,317,291

[45] Date of Patent: May 31, 1994

[54] MICROSTRIP FILTER WITH REDUCED GROUND PLANE

[75] Inventor: Allen F. Podell, Palo Alto, Calif.

[73] Assignee: Pacific Monolithics, Inc., Sunnyvale, Calif.

[21] Appl. No.: 20,044

[22] Filed: Feb. 19, 1993

Related U.S. Application Data

[63] Continuation-in-part of Ser. No. 882,447, May 12, 1992, abandoned.

[51] Int. Cl.[5] ..... H01P 1/203; H01P 1/205

[52] U.S. Cl. ..... 333/203; 333/204; 333/205

[58] Field of Search ..... 333/202, 203-205, 333/219, 238, 246

[56] References Cited

U.S. PATENT DOCUMENTS

| | | | |
|---|---|---|---|
| 2,915,716 | 12/1959 | Hattersley | 333/204 |
| 3,213,382 | 9/1963 | Hensel | 333/203 |
| 3,525,954 | 8/1970 | Rhodes | 333/203 |
| 3,562,677 | 2/1971 | Gunderson | 333/203 |
| 3,566,315 | 2/1971 | Vinding | 333/204 |
| 3,582,841 | 6/1971 | Rhodes | 333/203 |
| 3,617,954 | 11/1971 | Levy et al. | 333/204 |
| 4,224,587 | 9/1980 | Makimoto et al. | 333/205 |
| 4,467,296 | 8/1984 | Cohen et al. | 333/202 |
| 4,488,130 | 12/1984 | Young et al. | 333/203 |
| 4,721,931 | 1/1988 | Nishikawa et al. | 333/203 |

FOREIGN PATENT DOCUMENTS

| | | | |
|---|---|---|---|
| 0163401 | 7/1987 | Japan | 333/204 |
| 1465925 | 3/1989 | U.S.S.R. | 333/204 |

*Primary Examiner*—Robert J. Pascal
*Assistant Examiner*—Seungsook Ham
*Attorney, Agent, or Firm*—Edward B. Anderson

[57] ABSTRACT

This microstrip comb line filter includes a planar dielectric substrate, and a planar ground member positioned on one side of the dielectric substrate and extending along a first portion of the substrate. There is a second portion of the substrate along which the ground member does not extend, thereby forming a cavity filled with air. A plurality of generally parallel, electromagnetically coupled and spaced-apart, elongate microstrip conductors are positioned on the other side of the dielectric substrate. One end of each of the conductors is positioned adjacent to the first portion of the substrate and connected to the ground member. The other end of each of the conductors is electrically spaced from the ground member and positioned adjacent to the second portion of the substrate. The air cavity extends along at least half the length of the conductors.

4 Claims, 3 Drawing Sheets

MICROSTRIP FILTER WITH REDUCED GROUND PLANE

This is a continuation-in-part of copending U.S. application Ser. No. 07/882,447 (now abandoned) filed on May 12, 1992.

BACKGROUND OF THE INVENTION

1. Field of the Invention

This invention relates to microstrip filters, and more specifically, to such filters having cascaded coupled microstrips transverse of a transmission line.

2. Description of Related Art

In most microstrip filters, the velocity inequalities between the odd and even modes are tolerated, or they can be equalized to improve harmonic responses. In these filters, the relative velocities are modified to allow the placement of stop band zeroes where they are desired.

It is known that cascaded equal length parallel microstrips shorted at one end and open at the other end, form an all-stop structure, even when they are one-quarter wavelength long. When these strips are end loaded with capacitance, as what is referred to as a comb-line filter, the pass band and stop bands separate. Typical comb-line filters use approximately one-eighth wavelength strips, and exhibit band-stop characteristics at about twice the pass band frequency.

Comb-line or similar filters are well established for use in wave guides. For instance, Hensel, in U.S. Pat. No. 3,213,382 entitled "Broadband Coupling to Comb Filter", discloses a filter formed of a plurality of conductive rods transverse to the wave guide for providing control of the upper and lower cut-off frequencies by varying the capacitances of the relevant circuits.

It is known to vary the coupling between comb elements by applying different structure to different sections of the elements. In U.S. Pat. No. 3,582,841 entitled "Ladder Line Elliptic Function Filter", Rhodes discloses changing the size and/or relative position of the parallel elements between connected sections. This approach is also developed in different ways by Makimoto et al. in U.S. Pat. No. 4,224,587 entitled "Comb-line Bandpass Filter", Rhodes in U.S. Pat. No. 3,525,954 entitled "Stepped Digital Filter", and by Levy et al. in U.S. Pat. No. 3,617,954 entitled "Semi-lumped Comb Line Filter".

Young et al., in U.S. Pat. No. 4,488,130 entitled "Microwave Integrated Circuit, Bandpass Filter" discloses the use of resonators extending from a wave guide, which resonators have sections with different shapes.

Other types of microstrip filters are also well known. Hattersley, in U.S. Pat. No. 2,915,716 entitled "Microstrip Filters", discloses the use of a plurality of tabs disposed along a conductor, with stubs extending from one end of the tabs connected to a ground-plane conductor. Vinding, in U.S. Pat. No. 3,566,315 entitled "Strip Line Electrical Filter Element", discloses using the capacitance of opposing fan-shaped conductive elements distributed along a conductor relative to a ground plane as a filter. Ishikawa in Japanese Pat. No. 62-163401 discloses omitting a narrow portion of the ground plane under tips of an interdigitated microstrip filter, which decreases the capacitance between alternate electrodes more than the capacitance between adjacent electrodes.

Cohen et al., in U.S. Pat. No. 4,467,296 entitled "Integrated Electronic Controlled Diode Filter Microwave Networks", disclose using bias-controlled diodes connected to resonant conductors to vary dynamically the filter characteristics. Similarly, in Soviet Union Pat. No. 1465925, a narrow section of the ground plane under the open ends of resonator conductors of a comb line filter is replaced with a conductive plate spaced by a narrow gap from the ground plane. This narrow gap is spanned by diodes that are biased to control the band-pass width of the resulting filter. This structure allows the pass band to be selected between a narrow pass-band when the diodes do not conduct to a wider pass-band when they do conduct.

The need for controlling filter characteristics, including characteristics of comb line microstrip filters, is thus well established.

SUMMARY OF THE INVENTION

The present invention provides a comb line microstrip filter that is structured to provide predetermined band-pass filter characteristics.

A microstrip comb line filter made according to the present invention includes a planar dielectric substrate, and a planar ground member positioned on one side of the dielectric substrate and extending along a first portion of the substrate. There is a second portion of the substrate along which the ground member does not extend. A plurality of generally parallel, electromagnetically coupled and spaced-apart, elongate microstrip conductors are positioned on the other side of the dielectric substrate. One end of each of the conductors is positioned adjacent to the first portion of the substrate and connected to the ground member. The other end of each of the conductors is electrically spaced from the ground member and positioned adjacent to the second portion of the substrate. The absence of the ground plane along the second portion of the substrate forms a non-conductive cavity that extends sufficiently along the conductors, typically at least half the length of the conductors, to produce the desired band-pass filter characteristic.

An input port is connected to a first conductor adjacent to the one conductor end for receiving the microwave signals. Correspondingly, an output port is connected to a second conductor also adjacent to the one conductor end for transmitting the filtered microwave signals.

The removing of a portion of the ground plane member moves the transmission zeros. The region where the ground plane has been removed is preferably simply left with a region of air, resulting in a higher Q.

These and other features and advantages of the present invention will be apparent from the following detailed description of the preferred embodiment of the invention, described for purposes of illustration but not limitation, and as illustrated in the accompanying drawings.

DETAILED DESCRIPTION OF THE PREFERRED EMBODIMENT

Figure 1:
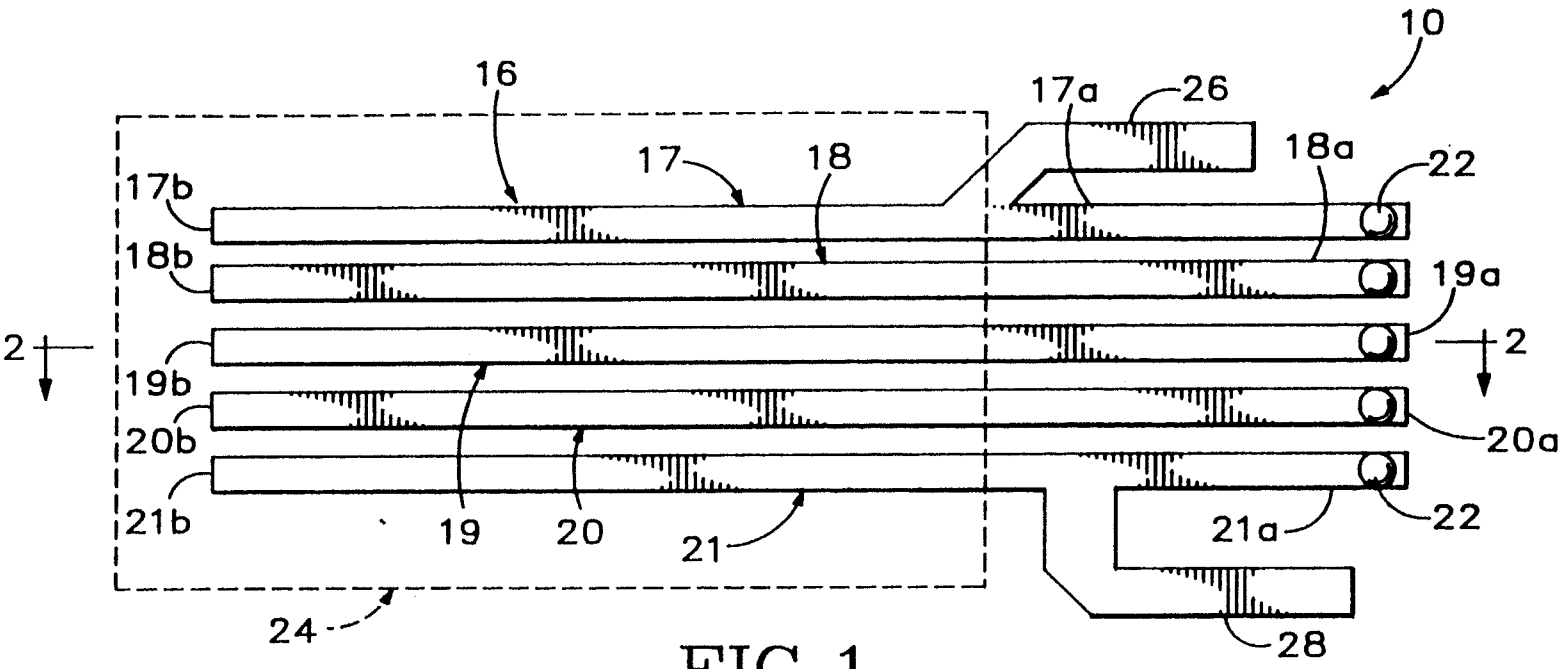
FIG. 1 is a plan view of a preferred embodiment of a microstrip filter made according to the present invention.
Figure 2:
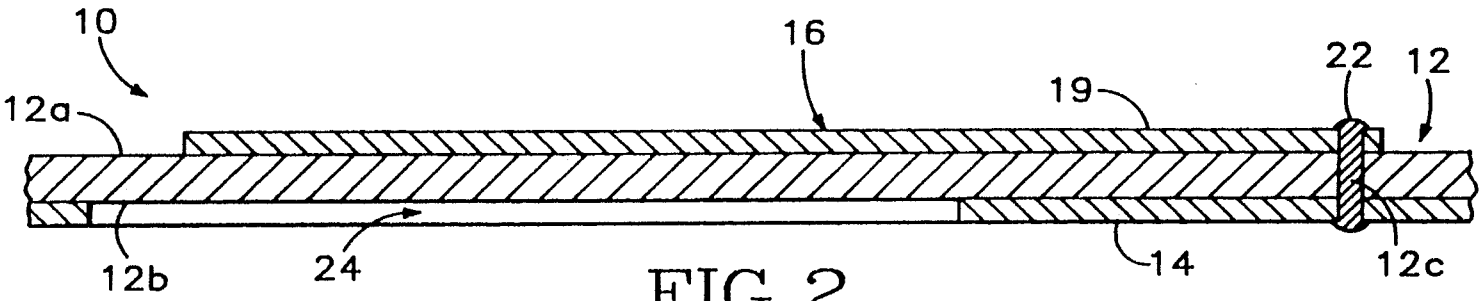
FIG. 2 is a cross section taken along line 2—2 of FIG. 1.

Referring initially to FIGS. 1 and 2, a microwave microstrip filter 10 made according to the invention is shown. Filter 10 includes a dielectric substrate 12 having a dielectric constant $\epsilon_r$, and top and bottom sides 12*a* and 12*b*, respectively, as viewed in FIG. 2. A conductive ground plane 14 is disposed on bottom side 12*b* of the substrate.

A set 16 of parallel microstrip conductors 17, 18, 19, 20 and 21 are disposed on top side 12*a* of the substrate. The conductors have first ends 17*a*–21*a* that are electrically connected to ground plane 14 by connectors 22 extending through via holes, such as via hole 12*c* in the substrate, as shown in FIG. 2. The other ends 17*b*–21*b* are physically, and therefore electrically spaced from the ground plane.

As shown in dashed lines in FIG. 1, and in the cross section of FIG. 2, a nonconductive cavity 24 below and adjacent to ends 17*b*–21*b* exists in ground plane 14 in which the ground plane has been completely removed, leaving preferably air to fill cavity 24. The cavity is positioned opposite the open ends 17*b*–21*b* of the conductors. As will be seen, the size of region 24 determines the filter characteristics desired. However, in order to provide a band-pass filter made with the conductor and substrate structure shown, the cavity must be at least about half the length of the conductors.

A microstrip input port 26 is connected to conductor 17 in line with the edge of cavity 24. Correspondingly, a microstrip output port 28 is connected to end 21*a* of conductor 21 near the edge of the cavity, as shown.

Since the ground plane is replaced with air having an effective dielectric constant of 1, the even mode dielectric constant is substantially diminished in this region, whereas the odd mode dielectric constant is hardly affected. Other nonconductive materials could also be used to fill the cavity. The pass band is thereby moved above the stop band, as is shown particularly in the curves of FIG. 5. These curves were generated for a filter having conductors that are all 0.0275 inches wide by 0.8200 inches long. This length corresponds to $\frac{1}{4}\lambda$ in air for a resonant frequency of about 3.6 GHz. The space between the conductors is 0.0125 inches. The preferred length of the air cavity 24 is about 0.6 inches along the length of the conductors. It is seen that the stop band is below about 2.3 GHz and the pass band is above about 2.5 GHz, with the dramatic transition between these frequencies. Above 2.9 GHz, the response drops almost as dramatically, as shown by curve 46 of FIG. 5.

The dielectric constant affects the pass and stop bands differently, as the pass band is most influenced by the even mode dielectric constant and the stop band is most influenced by the odd mode dielectric constant. The cavity causes the pass band to be above the stop band, and the insertion loss is reduced due to the presence of air beneath the conductors. This raises the unloaded Q. Moreover, the frequency of the even mode becomes less dependent on the dielectric constant of the substrate, enhancing production tolerances.

The odd mode dielectric constant remains approximately $\frac{1}{2}(\epsilon_r+1)$. To reduce the odd mode dielectric constant further, the gap between the conductors needs to approach or exceed the substrate thickness. This, however, is generally of limited use because the size of the filter is increased and the mathematical description of the odd mode dielectric constant becomes complicated. Even so, the loss is optimized by lowering the odd mode dielectric constant, lowering current density, and thus raising the odd mode conductor and dielectric Q.

Figure 3:
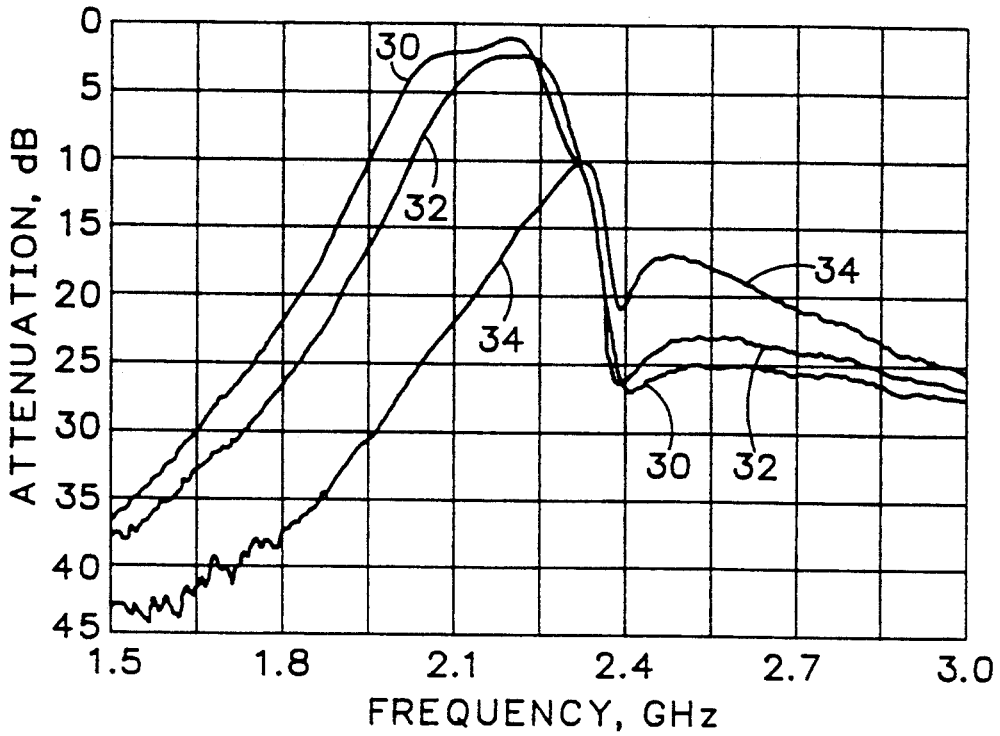
FIGS. 3 and 4 are charts showing the attenuation as a function of frequency of comb line filters having air gaps in the ground plane of differing lengths, somewhat less than that of the filter of FIG. 1.
Figure 4:
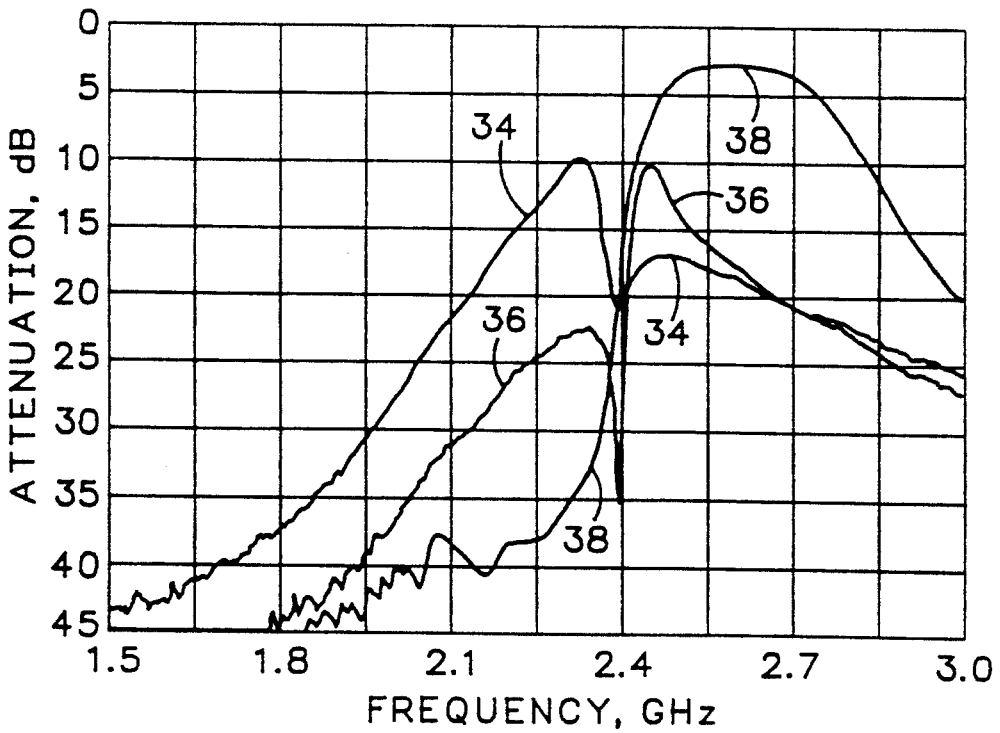

For conductors on a substrate having the dimensions noted, FIGS. 3 and 4 illustrate the comb line filter characteristics for differing lengths of the air gap. Referring to FIG. 3, curve 30 shows the attenuation of a conventional comb line filter having a full ground plane with no air gap. Curves 32 and 34 show the attenuation for comb line filters having respective air gaps of 0.05 inches and 0.15 inches. It is seen in all three of these cases that modest low-pass filter characteristics exist, with the pass band progressively decreasing in width and increasing in attenuation, and the stop band decreasing in attenuation. Thus, as the air gap increases the effectiveness of the filter deteriorates.

FIG. 4 shows a set of curves that illustrate the transition of the filter from a low-pass filter characteristic to a band-pass filter characteristic. Curve 34 is repeated to provide visual perspective relative to the curves of FIG. 3. Curve 36 illustrates a band-stop characteristic and corresponds to a cavity length of 0.3 inches. Curve 38 represents a modest band-pass characteristic and corresponds to a cavity length of 0.32 inches. It is then seen that a dramatic transition occurs as the cavity length approaches approximately 40% of the length of the conductors.

Figure 5:
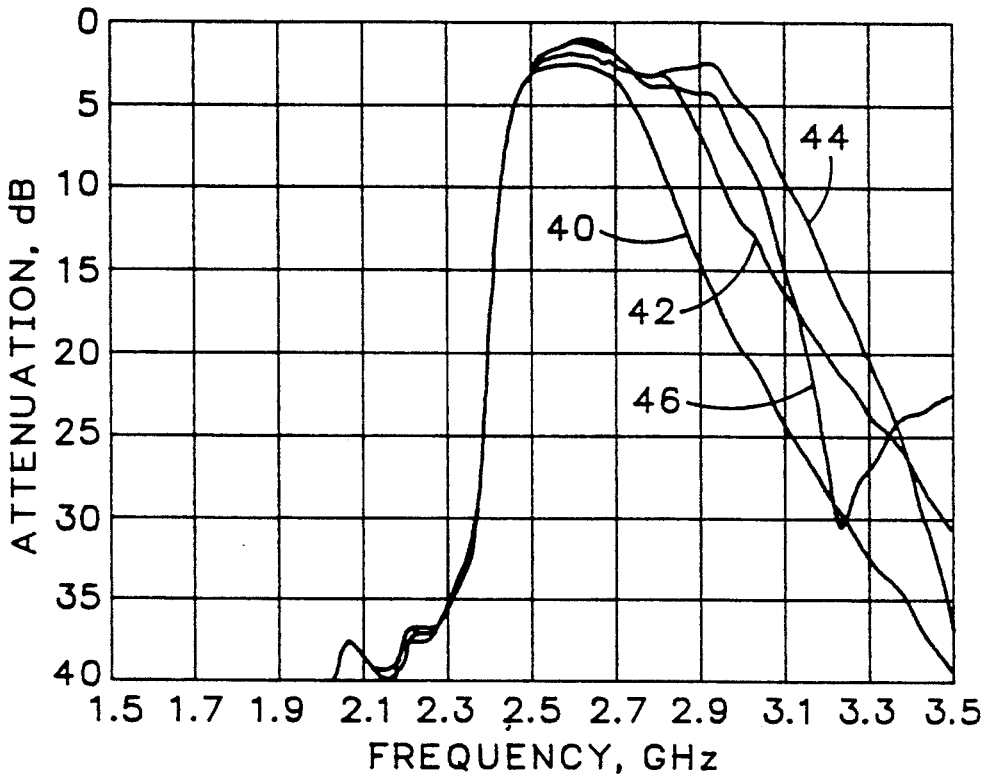
FIG. 5 is a chart showing the attenuation over a broader frequency range than is shown in FIGS. 3 and 4 of various comb line filters, including the filter of FIG. 1, having air gaps in the ground plane of differing lengths.

FIG. 5 illustrates on a different scale than that shown in FIGS. 3 and 4, the attenuation in dB of filters having even larger air cavity lengths. Curves 40, 42, 44 and 46, respectively correspond to filters having air cavity lengths of 0.32 inches, 0.35 inches, 0.4 inches, and 0.6 inches. Curve 46 represents the response for the embodiment of FIGS. 1 and 2. It is seen that the high frequency end of the pass band increases in frequency up to a cavity length of about 0.4 inches. For cavity lengths beyond one-half of the length of the conductors, however, a second dramatic transition occurs. Instead of continuing to increase, the pass band becomes more narrow, but more importantly, the high end roll-off is seen to be very steep, dropping about 15 dB in about 200 MHz. In comparison the roll-off for curve 42 is about 10 dB for the same frequency change. For greater frequency changes the difference in roll-off is even more dramatic.

It is thus seen that, when the air cavity is more than about one-half of the conductor length, which cavity length is represented by curve 45, a filter is produced with an increasingly narrow passband. A filter with an air cavity that is approximately three-fourths the conductor length, such as the filter represented by curve 46, exhibits highly desirable band-pass characteristics, a very rapid low-frequency roll-off, and a rapid high-frequency roll-off as well. Finally, where virtually all of the ground plane is removed, the passband becomes very narrow, the insertion loss increases, and the stop-band rejection substantially decreases. Thus, a cavity having a length of more than about nine-tenths the length of the conductors produces a relatively ineffective filter.

It will be apparent to one skilled in the art that variations in form and detail may be made in the preferred embodiment without varying from the spirit and scope of the invention as defined in the claims and any modification of the claim language or meaning as provided under the doctrine of equivalents. The preferred embodiment is thus provided for purposes of explanation and illustration, but not limitation.

We claim:

1. A microstrip comb-line filter for microwave signals comprising:

a planar dielectric substrate;

a planar ground member positioned on one side of the dielectric substrate and extending along a first portion of the substrate, there being a second portion of the substrate along which the ground member does not extend, and forming thereby a nonconductive cavity;

a plurality of parallel, electromagnetically coupled and spaced-apart, elongate microstrip conductors positioned on the other side of the dielectric substrate, one common end of each of the conductors being positioned adjacent to the first portion of the substrate and connected to the ground member, and the other end of each of the conductors being electrically spaced from the ground member and positioned adjacent to the second portion of the substrate, the nonconductive cavity associated with the second portion of the substrate extending at least half the length of each of the conductors and being sufficiently long to produce a high-pass characteristic above the band-pass zero in the filter;

an input port connected to a first conductor adjacent to the one end of said first conductor for receiving the microwave signals; and an output port connected to a second conductor adjacent to the one end of said second conductor for transmitting the filtered microwave signals.

2. A filter according to claim 1 wherein the cavity extends along three-fourths of the length of the conductors.

3. A filter according to claim 1 wherein the cavity is less than nine-tenths of the length of the conductors.

4. A microstrip comb-line filter for microwave signals comprising:

a planar dielectric substrate;

a planar ground member positioned on one side of the dielectric substrate and extending along a first portion of the substrate, there being a second portion of the substrate along which the ground member does not extend, and forming thereby a nonconductive cavity;

a plurality of parallel, electromagnetically coupled and spaced-apart, elongate microstrip conductors positioned on the other side of the dielectric substrate, one common end of each of the conductors being positioned adjacent to the first portion of the substrate and connected to the ground member, and the other end of each of the conductors being electrically spaced from the ground member and positioned adjacent to the second portion of the substrate, the nonconductive cavity associated with the second portion of the substrate extending along a sufficient length of each of the conductors to produce a pass band defined to be that portion of the filter characteristic within 3 dB of the minimum attenuation, said pass band having a high-pass characteristic above the band-pass zero in the filter, and the nonconductive cavity being at least as long as that length which produces a pass band having a maximum width;

an input port connected to a first conductor adjacent to the one end of said first conductor for receiving the microwave signals; and an output port connected to a second conductor adjacent to the one end of said second conductor for transmitting the filtered microwave signals.

* * * * *